US010665190B2

(12) United States Patent
Lee et al.

(10) Patent No.: US 10,665,190 B2
(45) Date of Patent: May 26, 2020

(54) POWER SUPPLY DEVICE AND DISPLAY DEVICE INCLUDING THE SAME

(71) Applicant: SAMSUNG DISPLAY CO., LTD., Yongin-si, Gyeonggi-do (KR)

(72) Inventors: Seokhwan Lee, Seoul (KR); Jongjae Lee, Hwaseong-si (KR); Junki Hong, Bucheon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 122 days.

(21) Appl. No.: 15/596,496

(22) Filed: May 16, 2017

(65) Prior Publication Data

US 2017/0337890 A1 Nov. 23, 2017

(30) Foreign Application Priority Data

May 18, 2016 (KR) ..... 10-2016-0061049

(51) Int. Cl.
*G09G 3/36* (2006.01)

(52) U.S. Cl.
CPC ..... *G09G 3/3677* (2013.01); *G09G 3/3688* (2013.01); *G09G 3/3696* (2013.01); *G09G 2300/0426* (2013.01); *G09G 2310/0289* (2013.01); *G09G 2310/061* (2013.01); *G09G 2310/08* (2013.01); *G09G 2330/021* (2013.01); *G09G 2330/12* (2013.01)

(58) Field of Classification Search
None
See application file for complete search history.

(56) References Cited

U.S. PATENT DOCUMENTS 8,217,676 B2 * 7/2012 Kwak ..... G09G 3/006 324/760.01
8,917,266 B2 * 12/2014 Park ..... G09G 3/2096 326/93
9,037,883 B2 5/2015 Huang et al.
(Continued)

FOREIGN PATENT DOCUMENTS

KR 10-2008-0091376 A 10/2008
KR 10-2009-0043575 A 5/2009
(Continued)

*Primary Examiner* — Bryan Earles
(74) *Attorney, Agent, or Firm* — Lewis Roca Rothgerber Christie LLP

(57) ABSTRACT

A power supply device includes a power circuit, feedback circuit, compensation circuit, and PWM controller. The power circuit generates an output voltage based on a PWM signal. The feedback circuit outputs a feedback voltage. The compensation circuit compares a reference voltage with the feedback voltage and outputs a compensation signal based on a comparison result. The PWM controller adjusts the duty ratio of the PWM signal based on the compensation signal. The compensation circuit includes a comparator to compare the feedback voltage with the reference voltage, a first voltage adjuster to adjust a voltage level of a compensation voltage based on the comparison result, and a compensator output the compensation signal based on the voltage level of the compensation voltage. The compensation signal has a width in a high section that varies. The booster boosts the response speed of the compensator in a predetermined section based on a control signal.

20 Claims, 9 Drawing Sheets

(56) References Cited

U.S. PATENT DOCUMENTS

| | | | | |
|---|---|---|---|---|
| 9,813,047 | B2 * | 11/2017 | Jayapal | H03K 3/356008 |
| 2005/0168198 | A1 * | 8/2005 | Maksimovic | H02M 1/4225 323/222 |
| 2009/0295770 | A1 * | 12/2009 | Woo | G09G 3/20 345/208 |
| 2010/0123446 | A1 * | 5/2010 | Cheng | H02M 3/1588 323/288 |
| 2014/0077857 | A1 * | 3/2014 | Poulton | H03K 5/133 327/278 |
| 2014/0333378 | A1 * | 11/2014 | Karthaus | H03F 3/2171 330/251 |
| 2016/0372172 | A1 * | 12/2016 | Shin | G11C 8/10 |
| 2016/0379581 | A1 * | 12/2016 | Takenaka | G09G 3/3648 345/212 |
| 2017/0213510 | A1 * | 7/2017 | Takenaka | H02M 3/156 |

FOREIGN PATENT DOCUMENTS

| | | | |
|---|---|---|---|
| KR | 10-2010-0054401 | A | 5/2010 |
| KR | 10-2015-0077149 | A | 7/2015 |
| KR | 10-2016-0012584 | A | 2/2016 |

* cited by examiner

POWER SUPPLY DEVICE AND DISPLAY DEVICE INCLUDING THE SAME

CROSS-REFERENCE TO RELATED APPLICATION

Korean Patent Application No. 10-2016-0061049, filed on May 18, 2016, and entitled, "Power Supply Device and Display Device Including the Same," is incorporated by reference herein in its entirety.

BACKGROUND

1. Field

One or more embodiments described herein relate to a power supply device and a display device including a power supply device.

2. Description of the Related Art

A liquid crystal display includes a driving circuit for driving a display panel. The display panel includes a liquid crystal layer between substrates with pixel and common electrodes. When a voltage is applied to the pixel and common electrodes from a power supply device, an electric field is generated to control the orientation of liquid crystal molecules in the liquid crystal layer. As a result, the polarization of incident light is controlled and an image is displayed. The power supply device may also generate voltages for operating the driving circuit.

SUMMARY

In accordance with one or more embodiments a power supply device includes a power circuit to generate an output voltage based on a PWM signal; a feedback circuit, connected to an output terminal of the power circuit, to output a feedback voltage; a compensation circuit to receive the feedback voltage, compare a predetermined reference voltage with the feedback voltage, and output a compensation signal according to a comparison result; and a PWM controller to adjust a duty ratio of the PWM signal based on the compensation signal. The compensation circuit includes a comparator to compare the feedback voltage with the reference voltage; a first voltage adjuster to adjust a voltage level of a compensation voltage based on the comparison result; a compensator to receive the compensation voltage and output the compensation signal based on the voltage level of the compensation voltage, the compensation signal having a width in a high section that varies; and a booster, between the first voltage adjuster and the compensator, to boost a response speed of the compensator in a predetermined section based on a control signal.

The booster may include a second voltage adjuster, connected in parallel to the first power adjuster, to adjust the voltage level of the compensation voltage based on the comparison result; and a switching circuit to control operation of the second voltage adjuster based on the control signal. When the feedback voltage is less than the reference voltage, the comparator may output a first switching signal in a high state through a first terminal and a second switching signal in a low state through a second terminal. When the feedback voltage is greater than the reference voltage, the comparator may output the first switching signal in a low state through the first terminal and the second switching signal in a high state through the second terminal.

The first voltage adjuster may include a first switching transistor including a gate electrode to receive the first switching signal, a drain electrode connected to a sourcing voltage terminal, and a source electrode connected to an output node to output the compensation voltage; and a second switching transistor including a gate electrode to receive the second switching signal, a drain electrode connected to the output node, and a source electrode connected to a reference voltage terminal.

The switching circuit may include a third switching transistor including a gate electrode to receive a first control signal in the control signal, a drain electrode connected to the sourcing voltage terminal, and a source electrode connected to the second voltage adjuster; and a fourth switching transistor with a gate electrode to receive a second control signal in the control signal, a drain electrode connected to the second voltage adjuster, and a source electrode connected to the reference voltage terminal.

The second voltage adjuster may include a fifth switching transistor including a gate electrode to receive the first switching signal, a drain electrode connected to the source electrode of the third switching transistor, and a source electrode connected to the output node; and a sixth switching transistor including a gate electrode to receive the second switching signal, a drain electrode connected to the output node, and a source electrode connected to the drain electrode of the fourth switching transistor.

The compensation circuit may include a reset circuit to output a reset signal to reset the booster; and a controller to generate the first and second control signals based on a predetermined prediction signal and the reset signal. When the reference voltage and the feedback voltage have a same magnitude, the comparator may supply the third switching signal to the reset circuit.

In accordance with one or more other embodiments, a display device includes a display panel to display an image; a driver to drive the display panel; and a power supply to supply a driving voltage to the driver. The power supply includes power circuit to generate an output voltage based on a PWM signal; a feedback circuit, connected to an output terminal of the power circuit, to output a feedback voltage; a compensation circuit to receive the feedback voltage, compare a predetermined reference voltage with the feedback voltage, and output a compensation signal according to a comparison result; and a PWM controller to adjust a duty ratio of the PWM signal based on the compensation signal. The compensation circuit may include a comparator to compare the feedback voltage with the reference voltage; first voltage adjuster to adjust a voltage level of a compensation voltage based on the comparison result; a compensator to receive the compensation voltage and output the compensation signal based on the voltage level of the compensation voltage, the compensation signal having a width in a high section that varies; and a booster, between the first voltage adjuster and the compensator, to boost a response speed of the compensator in a predetermined section based on a control signal.

The compensation circuit may include a reset circuit to output a reset signal to reset the booster; and a controller to generate the first and second control signals based on a prediction signal and the reset signal.

The controller may include a detector to receive a load current from the power circuit and to calculate a representative load current based on the load current; a comparator to compare the representative load current with a predetermined reference current and output a result signal based on a comparison result; and an A/D converter to convert the result signal to analog form.

The display device may include a signal controller to control a drive of the driver, wherein the signal controller may receive the result signal from the compensator, generate the prediction signal based on the result signal, and supply the generated prediction signal to the compensator.

The detector may receive the load current by one frame unit during a predetermined detection section, and the predetermined detection section may correspond to k frames, where k is a natural number of 1 or more. In one embodiment, i points are to be set at each of the k frames; and the detector is to receive i load currents for the i points based on a reference clock and calculate the representative load current for each point based on a load current for each of the i points detected during the detection section.

The driver may include a data driver to supply a data signal to the display panel; and a gate driver to supply a gate signal to the display panel, wherein the signal controller is to generate the reference clock based on a vertical start signal to start operation of the gate driver and supply the reference clock to the detector.

The booster may include a second voltage adjuster, connected in parallel to the first power adjuster, to adjust the voltage level of the compensation voltage according to the comparison result; and a switching circuit to control operation of the second voltage adjuster based on the control signal. When the feedback voltage is less than the reference voltage, the comparator may output a first switching signal in a high state through a first terminal and a second switching signal in a low state through a second terminal, and when the feedback voltage is greater than the reference voltage, the comparator may output the first switching signal in a low state through the first terminal and the second switching signal in a high state through the second terminal.

The first voltage adjuster may include a first switching transistor includes a gate electrode to receive the first switching signal, a drain electrode connected to a sourcing voltage terminal, and a source electrode connected to an output node to output the compensation voltage; and a second switching transistor including a gate electrode to receive the second switching signal, a drain electrode connected to the output node, and a source electrode connected to a reference voltage terminal.

The switching circuit may include a third switching transistor including a gate electrode to receive a first control signal in the control signal, a drain electrode connected to the sourcing voltage terminal, and a source electrode connected to the second voltage adjuster; and a fourth switching transistor with a gate electrode to receive a second control signal in the control signal, a drain electrode connected to the second voltage adjuster, and a source electrode connected to the reference voltage terminal.

The second voltage adjuster may include a fifth switching transistor including a gate electrode to receive the first switching signal, a drain electrode connected to the source electrode of the third switching transistor, and a source electrode connected to the output node; and a sixth switching transistor including a gate electrode to receive the second switching signal, a drain electrode connected to the output node, and a source electrode connected to the drain electrode of the fourth switching transistor.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
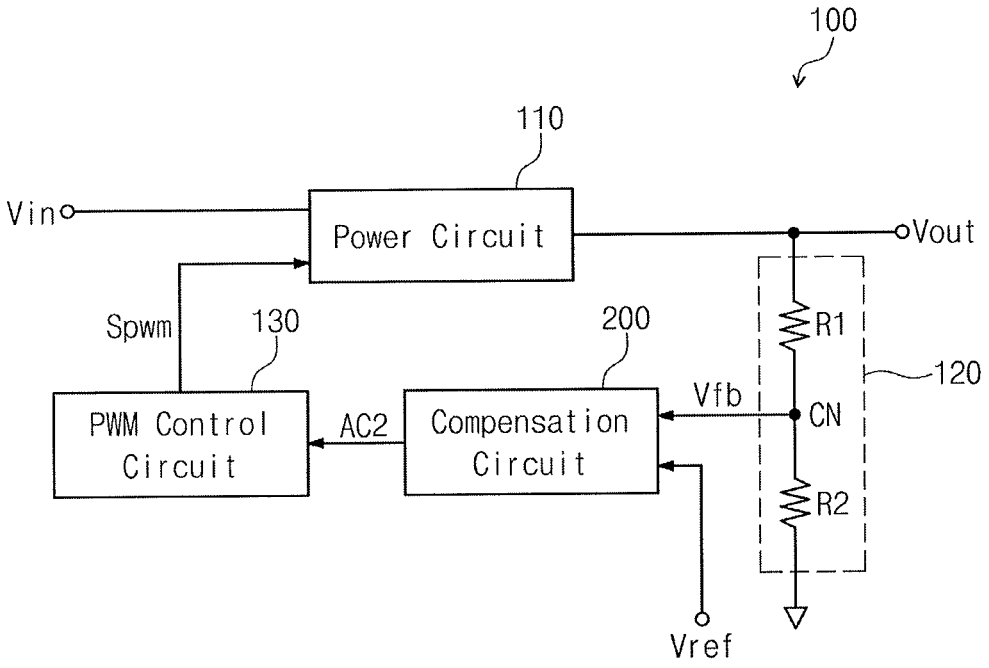
FIG. 1 illustrates an embodiment of a power supply device.

Example embodiments are described more fully hereinafter with reference to the drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments (or portions thereof) may be combined to form additional embodiments.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a power supply device 100 which may include a power circuit 110, a feedback circuit 120, a PWM control circuit 130, and a compensation circuit 200. The power supply circuit 110 receives an input voltage Vin from an external source and converts the input voltage Vin to an output voltage Vout based on the PWM signal Spwm. The output voltage Vout may have a higher voltage level than the input voltage Vin. The power supply circuit 110 may be a boosting circuit for boosting the input voltage Vin.

The feedback circuit 120 is connected to the output terminal of the power supply circuit 110 and includes first and second resistors R1 and R2. The first and second resistors R1 and R2 are connected in series between the output terminal and a reference (e.g., ground) voltage terminal. The feedback voltage Vfb is output from a coupling node CN where the first and second resistors R1 and R2 are connected. The feedback voltage is provided to the compensation circuit 200.

The compensation circuit 200 compares the feedback voltage Vfb with a predetermined reference voltage Vref, generates a compensation signal AC2 based on the comparison result, and provides the compensation signal AC2 to the PWM control circuit 130. The PWM control circuit 130 adjusts the duty ratio of the PWM signal Spwm based on the compensation signal AC2 and supplies the adjusted duty ratio to the power supply circuit 110. For example, when the feedback voltage Vfb is greater than the reference voltage Vref, the PWM control circuit 130 decreases the duty ratio of the PWM signal Spwm in order to reduce the voltage level of the output voltage Vout. When the feedback voltage Vfb is less than the reference voltage Vref, the PWM control circuit 130 increases the duty ratio of the PWM signal Spwm in order to raise the voltage level of the output voltage Vout.

Figure 2:
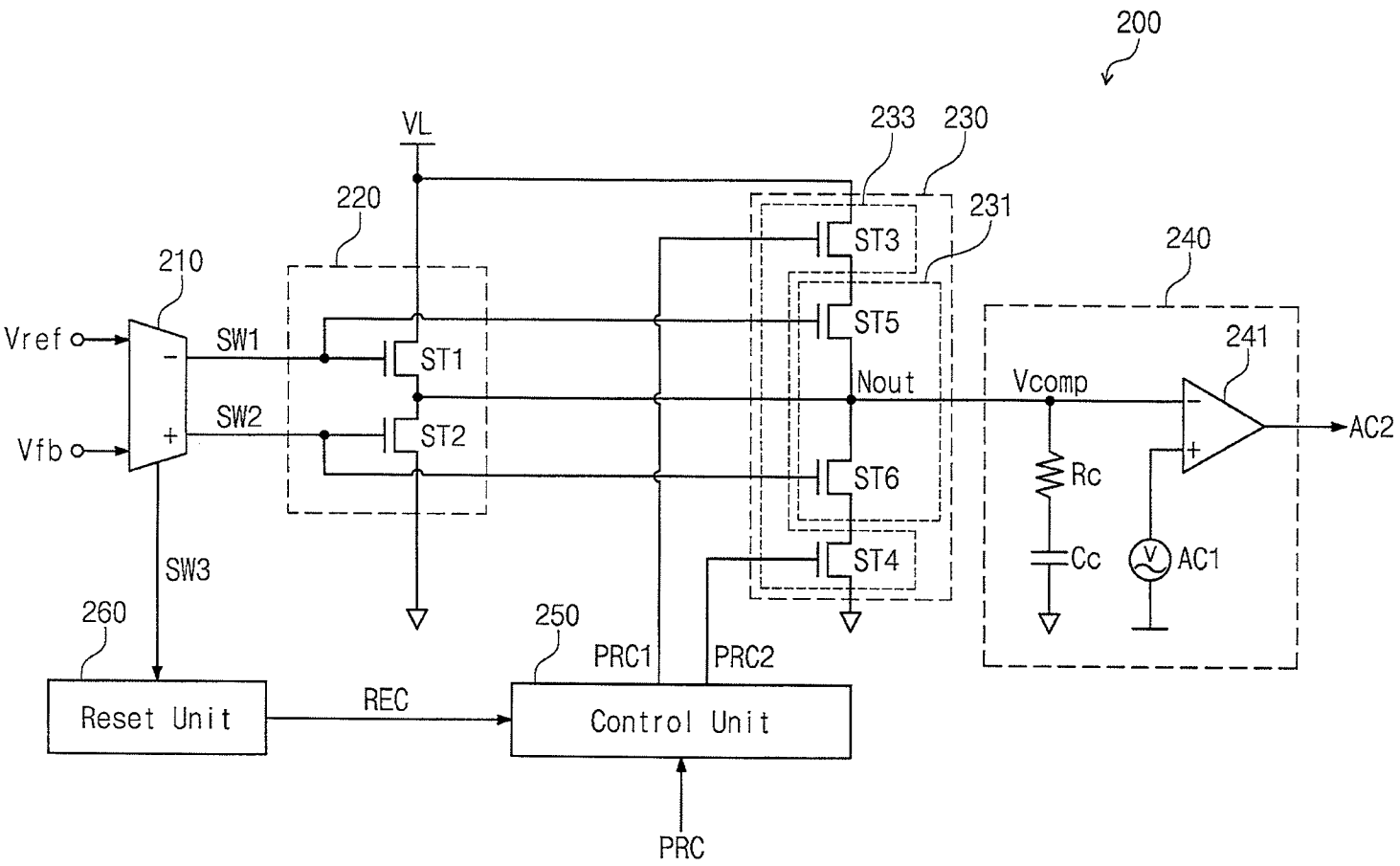
FIG. 2 illustrates an embodiment of a compensation circuit.
Figure 3:
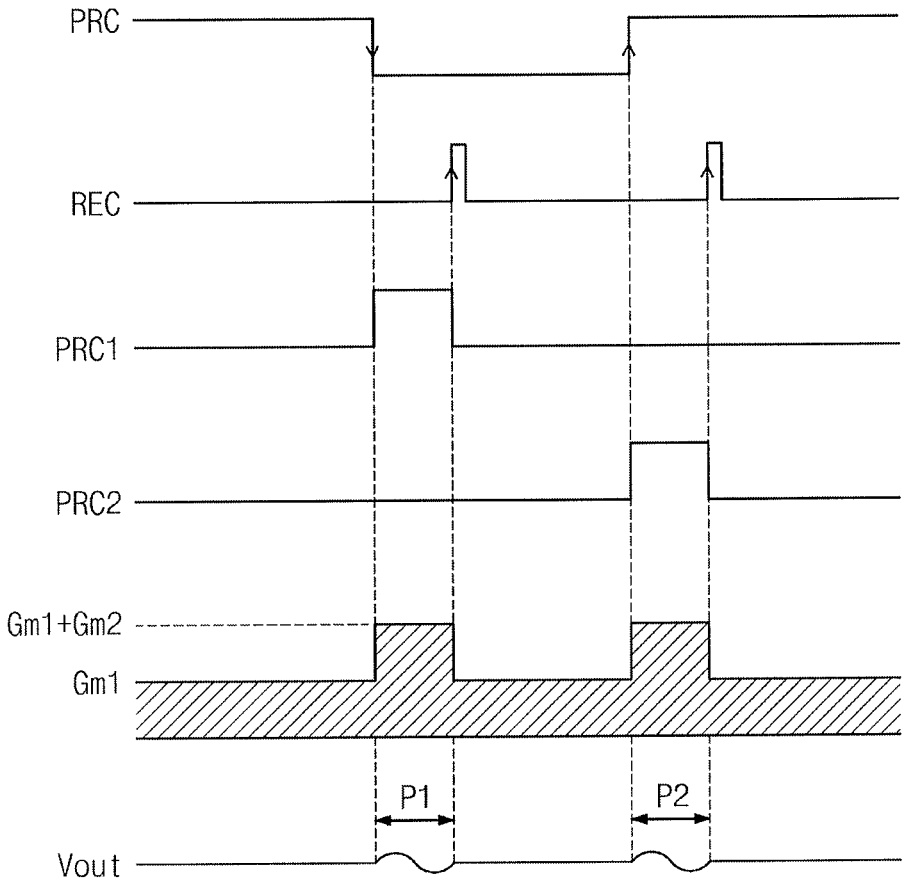
FIG. 3 illustrates an embodiment of waveforms for the compensation circuit.

FIG. 2 illustrates an embodiment of the compensation circuit 200 in FIG. 1. FIG. 3 illustrates an embodiment including a current waveform and a compensation voltage at an output node in FIG. 2.

Referring to FIG. 2, the compensation circuit 200 includes a comparison unit 210 (e.g., a comparator), a first voltage adjustment unit 220 (e.g., a first voltage adjustment circuit), a boosting unit 230 (e.g., a booster), and a compensation unit 240 (e.g., a compensator). The comparison unit 210 compares the feedback voltage Vfb with the reference voltage Vref. The first voltage adjustment unit 220 adjusts a compensation voltage Vcomp based on a comparison result of the comparator 210.

The compensation unit 240 receives the compensation voltage Vcomp and outputs the compensation signal AC2. The compensation signal AC2 has a width in a high section that varies based on the voltage level of the compensation voltage Vcomp. The boosting unit 230 is between the first voltage adjustment unit 220 and compensation unit 240 and boosts the response speed of the compensation unit 240 in a predetermined section based on the control signals PRC1 and PRC2.

In one embodiment, the comparison unit 210 includes a multiplexer that receives the feedback voltage Vfb from the feedback circuit 120 (e.g., see FIG. 1) and compares the feedback voltage Vfb with the reference voltage Vref. The comparison unit 210 outputs first and second switching signals SW1 and SW2 according to the comparison result. For example, when the reference voltage Vref is greater than the feedback voltage Vfb, the first switching signal SW1 has a high state and the second switching signal SW2 has a low state. When the reference voltage Vref is less than the feedback voltage Vfb, the first switching signal SW1 has a low state and the second switching signal SW2 has a high state.

The first voltage adjustment unit 220 adjusts the potential (e.g., compensation voltage Vcomp) of the output node Nout based on the first and second switching signals SW1 and SW2. The first voltage adjustment unit 220 includes first and second switching transistors ST1 and ST2. The first switching transistor ST1 includes a gate electrode for receiving the first switching signal SW1 from the comparison unit 210, a drain electrode for receiving a sourcing voltage VL, and a source electrode connected to the output node Nout. The second switching transistor ST2 includes a gate electrode for receiving the second switching signal SW2 from the comparison unit 210, a drain electrode connected to the output node Nout, and a source electrode connected to the reference (e.g., ground) voltage terminal.

The trans-conductance of each of the first and second switching transistors ST1 and ST2 may be defined as a first trans-conductance Gm1. When the first switching signal SW1 is output in a high state and the second switching signal SW2 is output in a low state, the first switching transistor ST1 is turned on and the second switching transistor ST2 is turned off. When the first switching transistor ST1 is turned on, the compensation voltage Vcomp rises to the sourcing voltage VL.

When the first switching signal SW1 is output in a low state and the second switching signal SW2 is output in a high state, the second switching transistor ST2 is turned on and the first switching transistor ST1 is turned off. When the second switching transistor ST2 is turned on, the compensation voltage Vcomp drops to the reference (e.g., ground) voltage.

When the boosting unit 230 does not operate, the potential of the compensation voltage Vcomp rises to the sourcing voltage VL or the response speed dropped by the reference (e.g., ground) voltage may be determined by the first trans-conductance Gm1.

The boosting unit 230 includes a second voltage adjustment unit 231 (e.g., a second voltage adjustment circuit) and a switching unit 233 (e.g., switch). The second voltage adjustment unit 231 is connected in parallel to the first power adjustment unit 220 and operates at the same time with the first voltage adjustment unit 220 based on the first and second switching signals SW1 and SW2, in order to change the voltage level of the compensation voltage Vcomp. The switching unit 233 controls operation of second voltage adjustment unit 231 based on first and second control signals PRC1 and PRC2.

The switching unit 233 includes third and fourth switching transistors ST3 and ST4 and the second voltage adjustment unit 231 includes fifth and sixth switching transistors ST5 and ST6.

The third switching transistor ST3 includes a gate electrode for receiving the first control signal PRC1, a drain electrode connected to the sourcing voltage terminal VL, and a source electrode connected to the second voltage adjustment unit 231. The fourth switching transistor ST4 includes a gate electrode for receiving the second control signal PRC2, a drain electrode connected to the second voltage adjustment unit 231, and a source electrode connected to the ground voltage terminal.

The fifth switching transistor ST5 includes a gate electrode for receiving the first switching signal SW1, a drain electrode connected to the source electrode of the third switching transistor ST3, and a source electrode connected to the output node Nout. The sixth switching transistor ST6 includes a gate electrode for receiving the second switching signal SW2, a drain electrode connected to the output node Nout, and a source electrode connected to the drain electrode of the fourth switching transistor ST4.

The trans-conductance of each of the fifth and sixth switching transistors ST5 and ST6 is defined as a second trans-conductance Gm2.

When the boosting unit 230 operates based on the first and second control signals PRC1 and PRC2, the compensation voltage Vcomp rises to the sourcing voltage VL or the response speed dropped by the reference (e.g., ground) voltage may be boosted by the second trans-conductance Gm2.

The compensation circuit 200 may also includes a control unit 250 (e.g., controller) and a reset unit 260 (e.g., reset circuit). The control unit 250 receives a prediction signal PRC from an external source. The prediction signal PRC reflects information on a section where a ripple is expected to occur from the output voltage Vout. In one embodiment, the prediction signal PRC may be a predetermined signal during setting of the power supply 100. In another embodiment, the prediction signal PRC may be a signal generated by detecting the magnitude of a load in real time and reflecting the detected result in real time.

The reset unit 260 outputs a reset signal REC for resetting the boosting unit 230. When the reference voltage Vref and feedback voltage Vfb have the same magnitude (or a difference between them falls within a predetermined tolerance), the comparison unit 210 may generate and output the third switching signal SW3 to the reset unit 260. In one embodiment, when the reference voltage Vref and the feedback voltage Vfb have the same magnitude (or fall within the predetermined tolerance) instantaneously, the comparison unit 210 may not output the third switching signal SW3. The comparison unit 210 may therefore output the third switching signal SW3 only when the reference voltage Vref and the feedback voltage Vfb are maintained with the same value (or are in the predetermined tolerance) for a time greater than a predetermined section or period.

The reset unit 260 generates the reset signal REC generated in a high state at the time when the third switching signal SW3 is generated, and supplies the generated reset signal REC to the controller 250.

The compensation unit 240 may include, for example, an op-amp 241 having a first input terminal connected to the output node Nout and a second input terminal for receiving a predetermined AC voltage AC1. The op-amp 241 compensates the AC voltage AC1 based on the compensation voltage Vcomp and outputs a compensation signal AC2. In one embodiment, a compensation resistor Rc and a compensation capacitor Cc may be connected in series between the first input terminal of the op-amp 241 and the ground voltage terminal.

Referring to FIGS. 2 and 3, a ripple may occur at the output voltage Vout during the first and second sections P1 and P2. A ripple occurring during the first section P1 may be in a form in which a voltage magnitude rises and drops. A ripple occurring during second section P2 may be in a form in which a voltage magnitude drops and rises.

The control unit 250 may receive the prediction signal PRC, which is switched to a low state at the start point of the first section P1 where the ripple is generated and which is switched to a high state from the start point of the second section P2. FIG. 3 shows an example of the prediction signal PRC that is preset during setting of the power supply 100. The prediction signal PRC may be different in another embodiment.

In one embodiment, a low section of the prediction signal PRC may be a section corresponding to a blank section in an operation frame of a display device for displaying an image. For example, the magnitude of a load at the start and end points of the blank section of the display device rapidly changes. As a result, a large ripple component may occur from the output voltage Vout. In order to reduce or minimize the size of the ripple component in the blank section, the low section of the prediction signal PRC may be set to correspond to the blank section.

The reset unit 260 generates the reset signal REC in a high state at a time point when the first section P1 ends and the feedback voltage Vfb and the reference voltage Vref become the same. The reset unit 260 may output the reset signal REC in a high state at a time point when the second section P2 ends and the feedback voltage Vfb and the reference voltage Vref become the same (or fall within a predetermined tolerance).

The control unit 250 generates the first and second control signals PRC1 and PRC2 based on the prediction signal PRC and reset signal REC. For example, the first control signal PRC1 is generated in a high state at the falling time point of the prediction signal PRC, and is switched to a low state at the first rising time point of the reset signal REC. The second control signal PRC2 is generated in a high state at the rising time point of the prediction signal PRC, and is switched to a low state at the second rising time point of the reset signal REC.

For example, the first and second control signals PRC1 and PRC2 may be generated during a predetermined section. The first and second sections P1 and P2, where each of the first and second control signals PRC1 and PRC2 is generated in a high state, may be sections that are not changed according to the size of a load and fixed. In another example, the size of a load connected to the power supply device 100 may be measured, and a section where the first and second control signals PRC1 and PRC2 are generated in a high state may be set according to the measured size of the load.

When the first and second control signals PRC1 and PRC2 are all in a low state, the boosting unit 230 does not operate and only the first voltage adjustment unit 220 operates. As a result, the op-amp 241 operates by the first trans-conductance Gm1. When one of the first or second control signals PRC1 and PRC2 is in a high state, the boosting unit 230 and the first voltage adjustment unit 220 may operate together.

Therefore, the trans-conductance of the op-amp 241 is boosted based on the sum of the first trans-conductance Gm1 and the second trans-conductance Gm2. As a result, the response speed of the op-amp 241 may be improved in the first and second sections P1 and P2. As a result, a ripple component may be instantaneously reduced at the output voltage Vout because a compensation operation is executed quickly.

The compensation circuit 200 has one boosting unit 230 in the embodiment of FIGS. 2 and 3. The compensation circuit 200 may include a plurality of boosting units 230, for example, connected in parallel, in another embodiment. When the compensation circuit 200 includes a plurality of boosting units 230, the control unit 250 may adjust the number of boosting units that are turned on, in order to adjust the size of a trans-conductance of the compensating unit 240.

Figure 4:
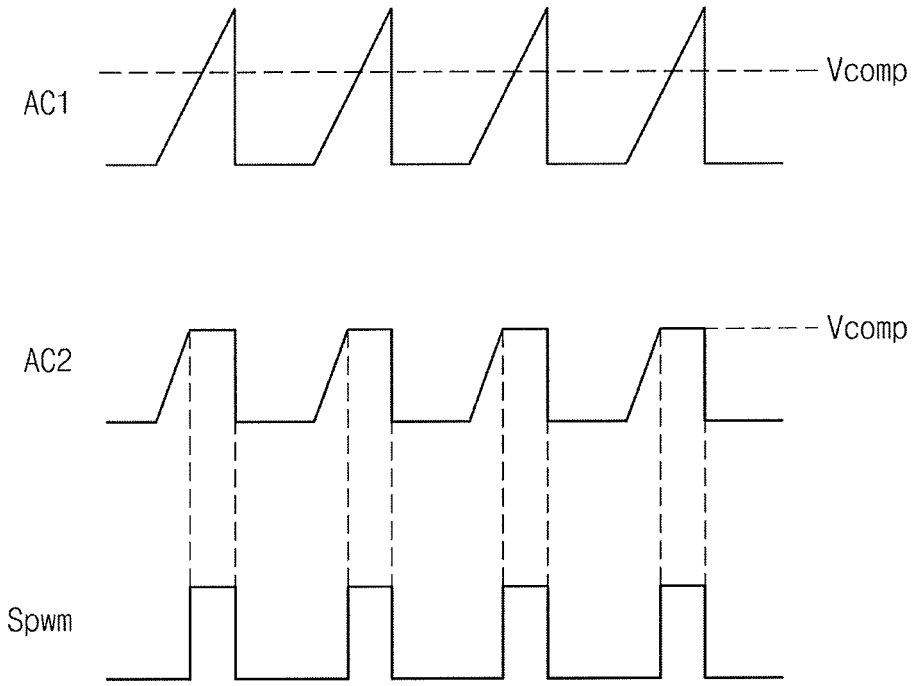
FIG. 4 illustrates an embodiment of waveforms for the compensation circuit.

FIG. 4 illustrates an embodiment of waveforms that include an input/output signal of a compensation unit in FIG. 2 and a PWM signal in FIG. 1. Referring to FIGS. 1, 2, and 4, the AC voltage AC1 may be a triangular wave generated in a predetermined period. The op-amp 241 compares the AC voltage AC1 with the compensation voltage Vcomp and outputs the compensation voltage Vcomp when the AC voltage AC1 is greater than the compensation voltage Vcomp. The op-amp 241 outputs the AC voltage AC1 when the AC voltage AC1 is less than the compensation voltage Vcomp. Accordingly, in this example, the op-amp 241 outputs the compensation signal AC2 in a trapezoidal waveform with a voltage level corresponding to the maximum compensation voltage Vcomp.

The width of a high section of the compensation signal AC2 varies depending on the magnitude of the compensation voltage Vcomp. For example, when the compensation voltage Vcomp rises to the sourcing voltage VL, the high section of the compensation signal AC2 has a first width. When the compensation voltage Vcomp drops down to the reference (e.g., ground) voltage, the high period of the compensation signal AC2 has a second width greater than the first width.

The PWM control circuit 130 adjusts the duty ratio of the PWM signal Spwm according to the high section width of the compensation signal AC2. The adjusted PWM signal Spwm is supplied to the power circuit 110 to adjust the voltage level of the output voltage Vout.

Figure 5:
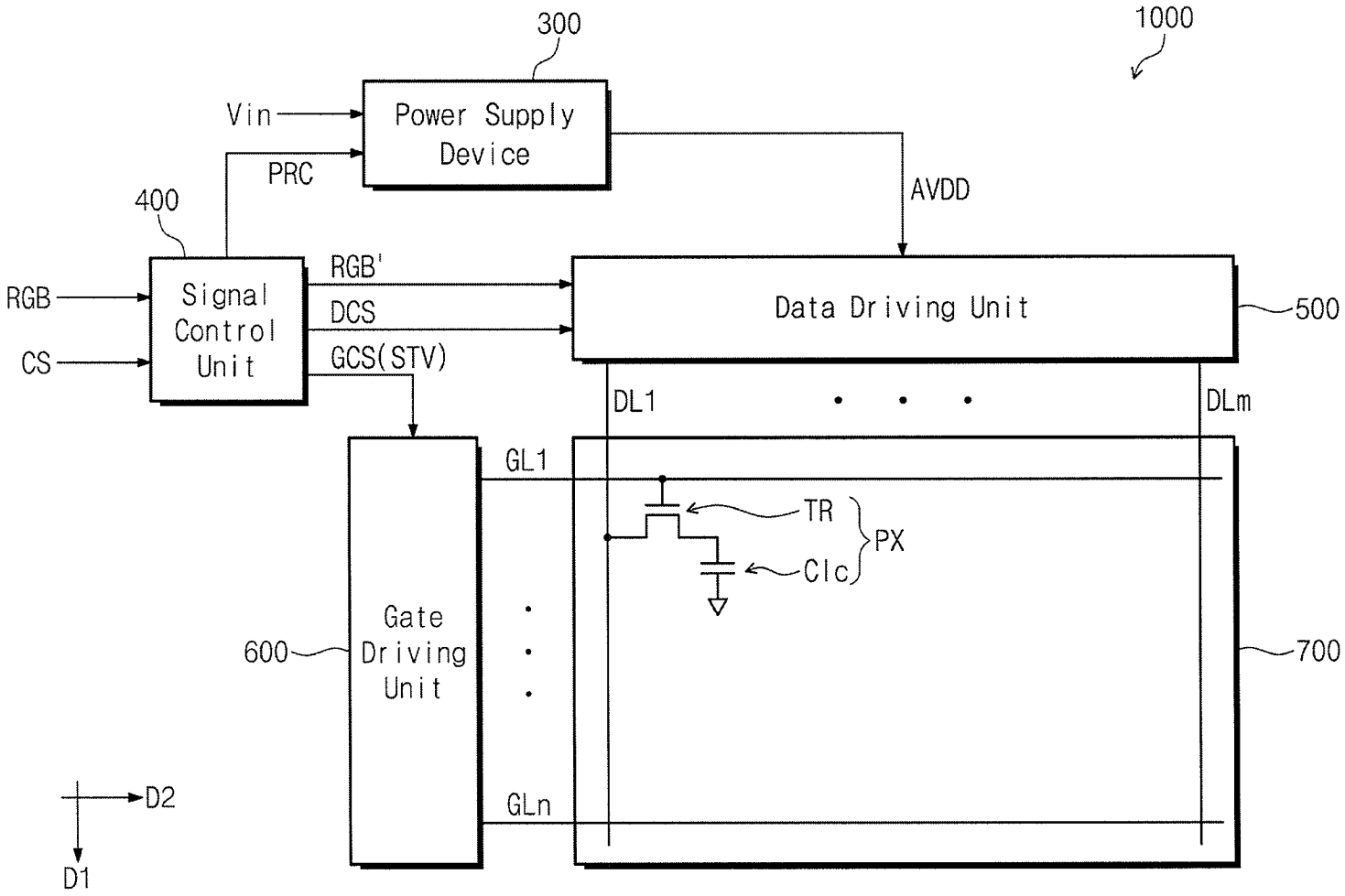
FIG. 5 illustrates an embodiment of a display device.

FIG. 5 illustrates an embodiment of a display device 1000 which includes a display panel 700, a signal control unit 400 (e.g., signal controller), a data driving unit 500 (e.g., data driver), a gate driving unit 600 (e.g., gate driver), and a power supply device 300.

The display panel 700 includes a plurality of data lines DL1 to DLm, a plurality of gate lines GL1 to GLn, and a plurality of pixels PX. The data lines DL1 to DLm extend in a first direction D1 and the gate lines GL1 to GLn extend in a second direction D2 intersecting the first direction D1. The pixels PX are connected to the data lines DL1 to DLm and the gate lines GL1 to GLn. Each pixel PX may be considered a unit to display image information. Each pixel PX may include a liquid crystal capacitance C1*c* connected to a thin film transistor TR. Each pixel PX may further include a storage capacitance connected in parallel to the liquid crystal capacitance C1*c*.

The display panel 700 may further include color filters to allow the pixels PX to emit light of a plurality of colors, e.g., red, green, blue, and white colors.

The signal control unit 400 receives input image data RGB and an image control signal CS from an external image board. The input image data RGB may be defined as an image data signal input to the display device 1000 from an external source.

The signal control unit 400 generates a gate control signal GCS and a data control signal DCS based on the image control signal CS and converts the format of the input image data RGB to generate converted image data RGB'. The gate driving unit 600 receives the gate control signal GCS from the signal control unit 400 and generates a gate signal based on the gate control signal GCS to output the generated gate signal to the display panel 700. The data driving circuit 500 receives the converted image data RGB' and the data control signal DCS from the signal control unit 400, and converts the converted image data RGB' into a data signal based on the data control signal DCS to output the data signal to the display panel 700.

The gate lines GL1 to GLn of the display panel 700 is connected to the gate driving unit 600 to receive the gate signal. The data lines DL1 to DLm receive the data signals from the data driving unit 500. Each pixel PX in the display panel 700 is connected to a corresponding gate line among the gate lines GL1 to GLn and a corresponding data line among the data lines DL1 to DLm. Accordingly, each of the pixels PX may display an image by the gate and data signals.

The display panel 700 displays an image by one frame unit. The one frame period may be set according to the driving frequency of the display panel 700. For example, when the display panel 700 operates at 60 Hz, the one frame section may be set to a section corresponding to 1/60 sec.

The power supply device 300 receives an input voltage Vin, converts the input voltage Vin to a driving voltage to drive the data driving unit 500, and outputs the driving voltage. The driving voltage may include an analog driving voltage AVDD for driving an analog part of the data driving unit 500 and a digital driving voltage for driving a digital part of the data driving unit 500. The analog driving voltage AVDD may be different in another embodiment.

The power supply device 300 improves the response speed of the compensation circuit 200 (e.g., FIG. 1) in the power supply device 300 based on the prediction signal PRC from the signal control unit 400. As a result, ripple generated from the analog driving voltage AVDD may be reduced. The prediction signal PRC may be a signal generated by reflecting the magnitude of a load in real time.

Figure 6:
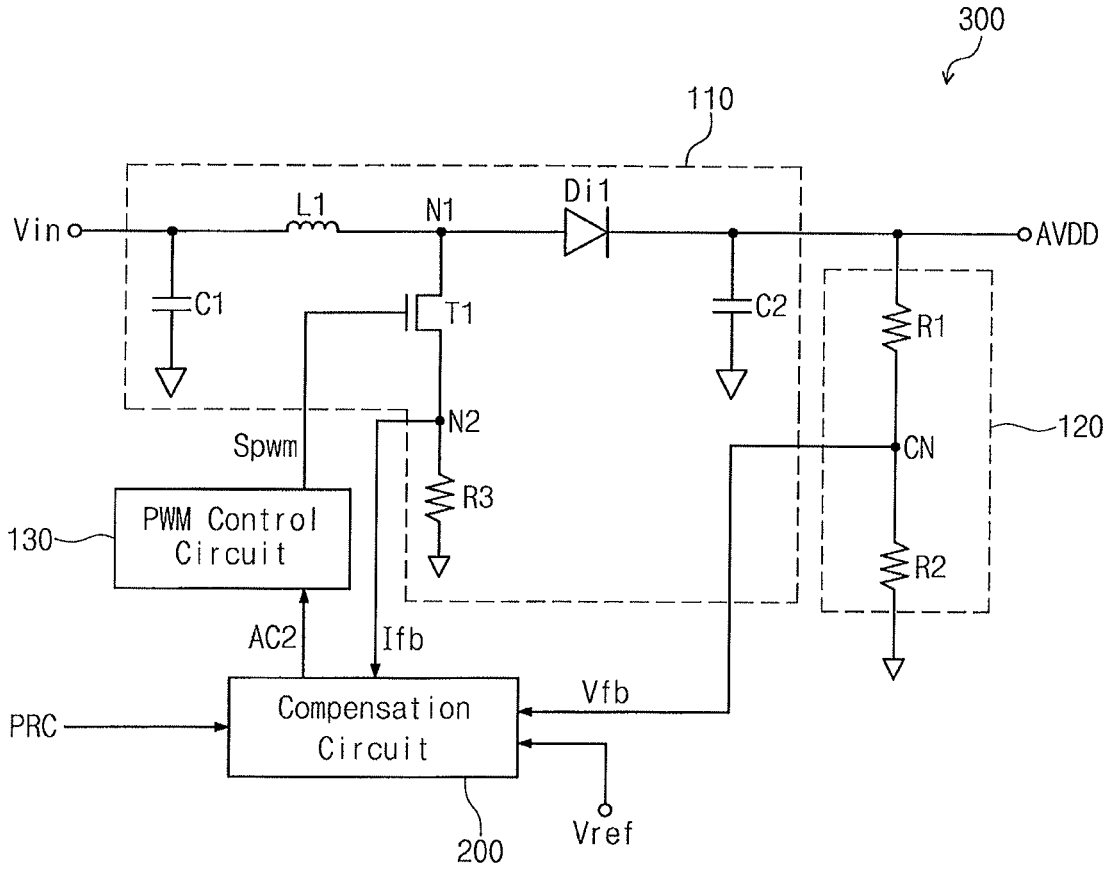
FIG. 6 illustrates an embodiment of a power supply device in FIG. 5.

FIG. 6 illustrates an embodiment of a power supply device 300, which, for example, may be in the display device in FIG. 5. The power supply device 300 may have a configuration similar to the power supply device 100 in FIG. 1, except for the following differences.

Referring to FIG. 6, the power supply device 300 may include a power circuit 110, a feedback circuit 120, a PWM control circuit 130, and a compensation circuit 200. The power supply circuit 110 may include a first coil L1, a first transistor T1, a first diode Di1, and a third resistor R3. The first coil L1 may include one end connected to the input terminal where the input voltage Vin is input and another end connected to a first node N1. The first diode Di1 includes an anode connected to the first node N1 and a cathode connected to the output terminal where the analog driving voltage AVDD is output. The first transistor T1 includes a gate electrode for receiving the PWM signal PWM from the PWM control circuit 130, a drain electrode connected to the first node N1, and a source electrode connected to the voltage terminal through third resistor R3.

A first capacitor C1 is connected between the input terminal and the reference (e.g., ground) voltage terminal. A second capacitor C2 is connected between the output terminal and the ground voltage terminal.

The on/off of the first transistor T1 is adjusted according to the signal level of the PWM signal Spwm output from the PWM control circuit 130. In addition, the turn-on/turn-off time of the first transistor T1 is determined according to the duty ratio of the PWM signal Spwm. The first transistor T1 is turned off when the PWM signal Spwm is in a low level. A current flowing through the first coil L1 is gradually increased in proportion to the input voltage Vin applied to different ends of the first coil L1 according to the current and voltage characteristics of the first coil L1. When the PWM signal Spwm is in a high level, the first transistor T1 is turned on and a current flowing through the first coil L1 flows through the first diode Di1.

A voltage is charged to the second capacitor C2 according to the current and voltage characteristics of the second capacitor C2. Therefore, the input voltage Vin is boosted to a predetermined voltage and outputted as the analog drive voltage AVDD.

The compensation circuit 200 is connected to a second node N2 of the power circuit 110 and receives a current as feedback. The second node N2 is a node where the third resistor R3 and the source electrode of the first transistor T1 are coupled. The current Ifb fed back to the compensation circuit 200 is provided to the control unit 250 of the compensation circuit 200 in FIG. 2. The compensation circuit 200 in FIG. 6 may have the same configuration as the compensation circuit 200 in FIG. 2, except for the configuration of the controller 250 that receives the feedback current Ifb.

Figure 7:
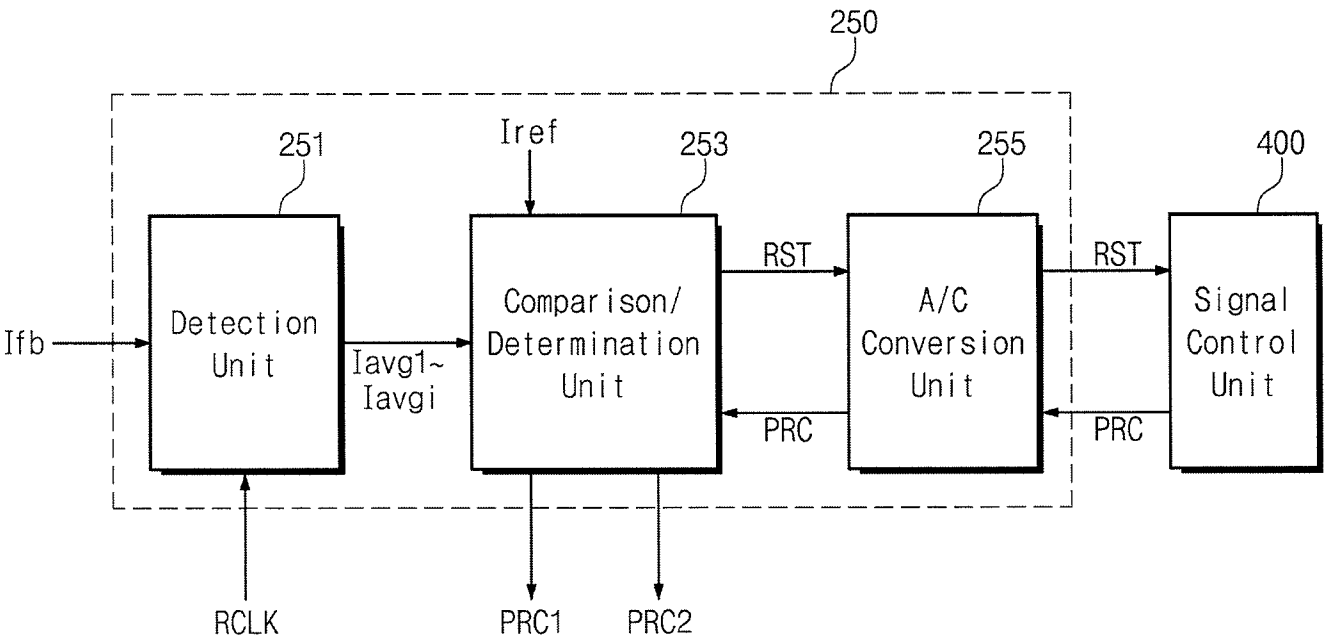
FIG. 7 illustrates an embodiment including control and signal control units.
Figure 8:
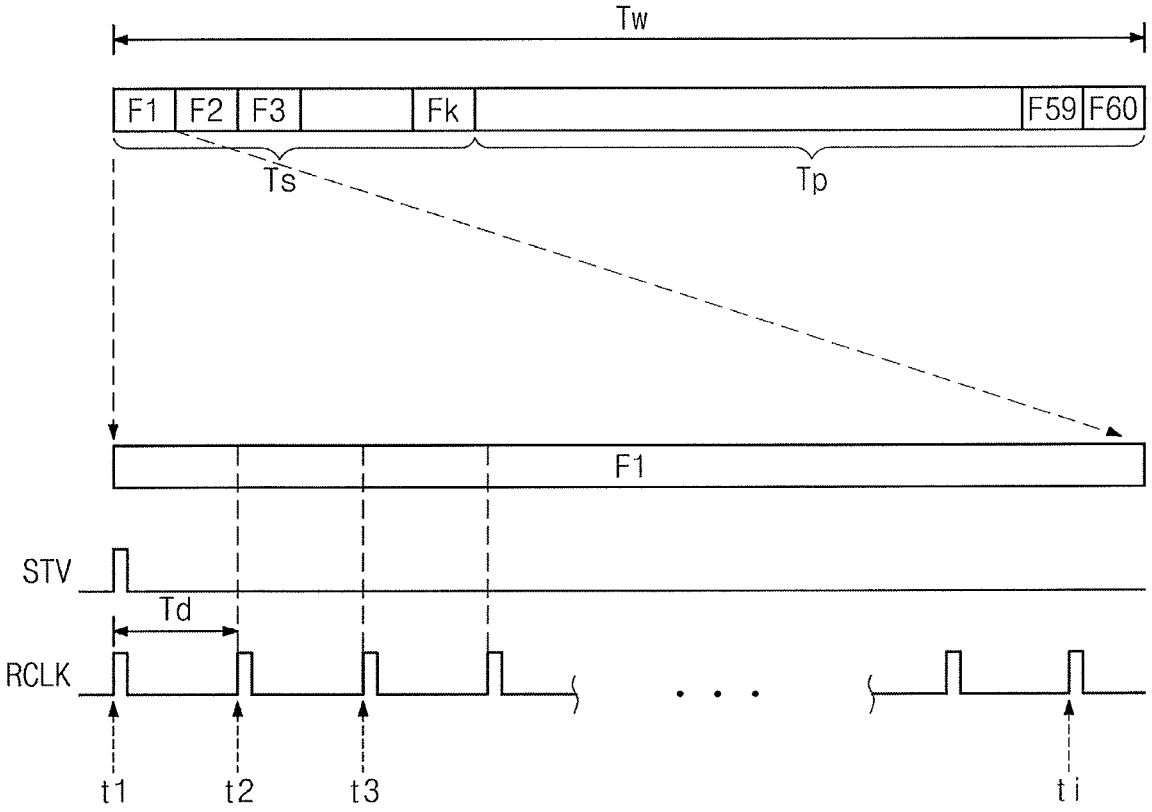
FIG. 8 illustrates an embodiment of waveforms including a window section, a detection section, and a reference clock.

FIG. 7 illustrates an embodiment of a control unit 250 and a signal control unit 400 of a compensation circuit in FIG. 6. FIG. 8 illustrates an embodiment of waveforms for a window section, a detection section, and a reference clock.

Referring to FIGS. 7 and 8, the control unit 250 of the compensation circuit 200 includes a detection unit 251, a comparison/determination unit 253, and an A/D conversion unit 255. The control unit 250 sets a window section Tw including a detection section Ts and an adjustment section Tp. The detection section Ts is a section for detecting a load change. The adjustment section Tp is a section synchronized with a signal obtained by reflecting the load change, in order to improve the response speed of the compensation circuit 200 and thereby removing the analog driving voltage AVDD.

The detection unit 251 receives the feedback current Ifb from the power circuit 110 during the detection section Ts. The feedback current Ifb may be the load current of the display panel 700. In one embodiment, the detection section Ts may be a section corresponding to k frames F1 to Fk, where k is a natural number of one or more. For example, when 60 frames are set as the window section Tw, the first 10 frames among them may be the detection sections Ts for receiving the load current Ifb. The remaining 50 frames may be the adjustment sections Tp.

The detection unit 251 may measure the load current Ifb in a predetermined period Td in each of the k frames F1 to Fk. In one embodiment, the gate control signal GCS (e.g., see FIG. 5) includes a vertical start signal (STV) for starting operation of the gate driving unit 600.

The signal control unit 400 generates a reference clock RCLK in the period Td from the generation time point of the vertical start signal STV during the detection section Ts. The detection unit 251 detects the load current Ifb in a section where the reference clock RCLK is high. For example, when the display panel 700 displays an image of one frame F1, the detection unit 251 may detect the load current Ifb at predetermined i points T1 to Ti.

When all the load information for each gate line is detected, only the load information on a gate line operating at a specific time point among the gate lines may be detected. This is because the amount of data increases.

The detection unit 251 calculates i representative load currents Iavg1 to Iavgi respectively corresponding to the i points T1 to Ti during the detection section Ts. For example, the detection unit 251 receives k load currents measured during the k frames F1 to Fk at the respective points T1 to Ti, calculates an average value of the k load currents, and generates the average value as a representative load current at each point.

The comparison/determination unit 253 receives the i representative load currents Iavg1 to Iavgi from the detection unit 251 and compares the i representative load currents Iavg1 to Iavgi with a predetermined preset reference current Iref to output a result signal RST.

Figure 9:
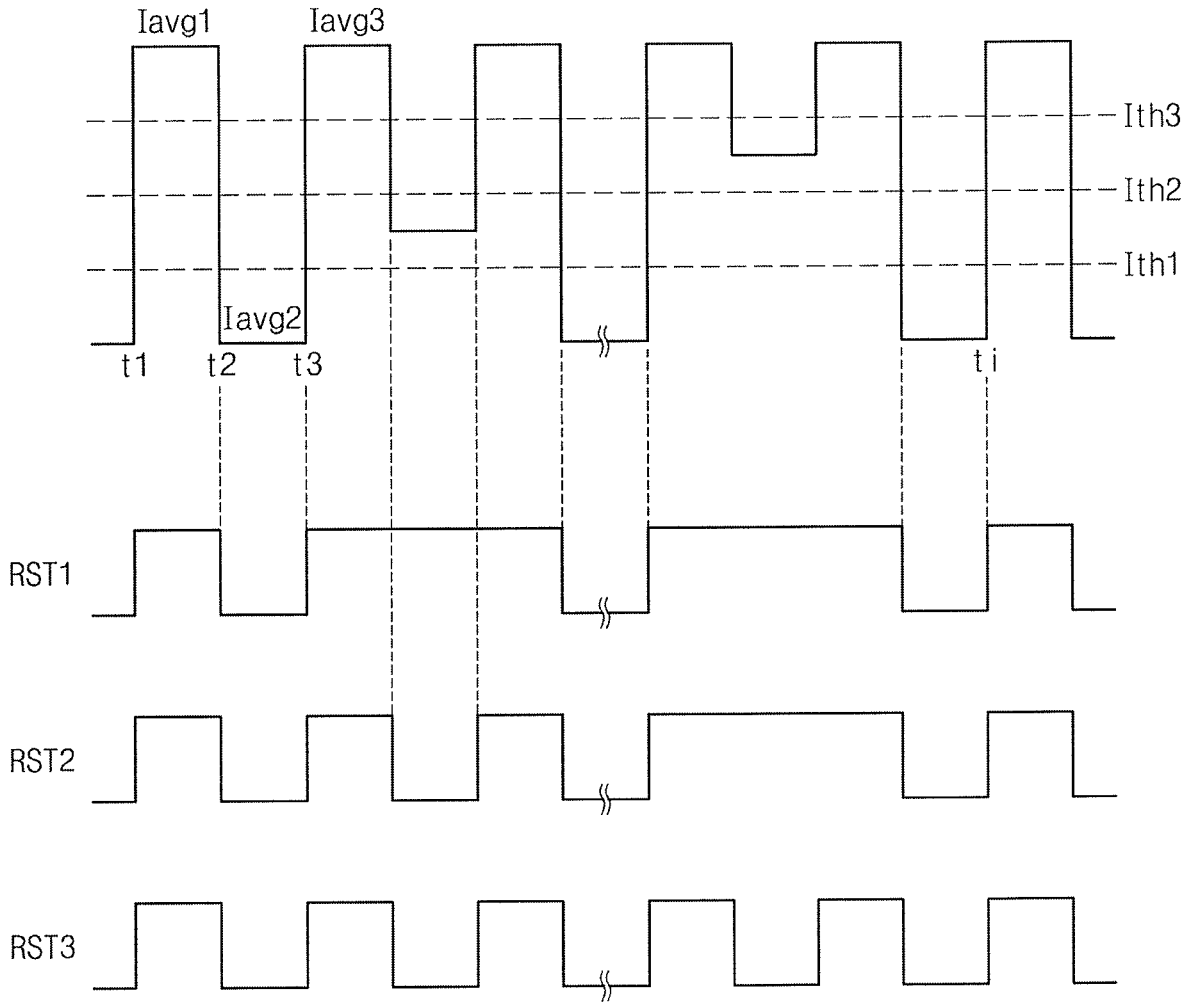
FIG. 9 illustrates an embodiment of a result signal.

FIG. 9 illustrates an embodiment of a result signal according to the level of a reference current. Referring to FIG. 9, the i representative load currents Iavg1 to Iavgi are output during one frame. The i representative load currents Iavg1 to Iavgi are representative load currents at the i points T1 to Ti.

The i representative load currents Iavg1 to Iavgi are compared with the reference current Iref. When the reference current Iref has a first threshold level Ith1, the comparison/determination unit 253 outputs a first signal RST1 as the result signal RST. When the reference current Iref has a second threshold level Ith2 greater than the first threshold level Ith1, the comparison/determination unit 253 outputs a second signal RST2 as the result signal RST. When the reference current Iref has a third threshold level Ith3 greater than the second threshold level Ith2, the comparison/determination unit 253 outputs a third signal RST3 as the result signal RST.

Referring again to FIG. 7, the result signal RST is converted to a digital signal by the A/D conversion unit 255 and is transmitted to the signal control unit 400. The signal control unit 400 generates a prediction signal PRC based on the result signal RST. The generated prediction signal PRC is converted to a digital signal and supplied to the A/D conversion unit 255. The A/D conversion unit 255 converts the digital signal to an analog form of the prediction signal PRC and then transmits the result to the comparison/determination unit 253. The comparison/determination unit 253 generates the first and second control signals PRC1 and PRC2 (e.g., see FIG. 3) based on the prediction signal PRC and the reset signal REC (e.g., see FIG. 2).

The load current of the display panel 700 is detected for several frames of the window section Tw. The detected result is reflected during the remaining frames, thereby generating the first and second control signals PRC1 and PRC2 supplied to the boosting unit 230 of the compensation circuit 200. Thus, by operating the boosting unit 230 at a time point when a ripple largely occurs, the response speed of the compensation unit 240 may be improved. As a result, it is possible to reduce or minimize the size of a ripple component actually generated from a driving voltage at the predicted ripple occurrence time point and to prevent malfunction of the display device 1000 due to the ripple component.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The control units, reset units, compensation circuits, and other signal processing features of the disclosed embodiments may be implemented in logic which, for example, may include hardware, software, or both. When implemented at least partially in hardware, the units, reset units, compensation circuits, and other signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the units, reset units, compensation circuits, and other signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In one embodiment, a power supply device may reduce or minimize the size of a ripple component generated from an output voltage, by operating a boosting unit at the expected ripple time in order to improve the response speed of a compensation unit. In addition, when the display device that operates based on the output voltage, malfunction due to the ripple component may be prevented.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A power supply device comprising:

a power circuit to generate an output voltage based on a PWM signal;

a feedback circuit, connected to an output terminal of the power circuit, to output a feedback voltage;

a compensation circuit to receive the feedback voltage, compare a reference voltage with the feedback voltage, and output a compensation signal according to a comparison result; and a PWM controller to adjust a duty ratio of the PWM signal based on the compensation signal, wherein the compensation circuit includes:

a comparator to compare the feedback voltage with the reference voltage and to concurrently output first and second switching signals;

a first voltage adjuster comprising a first switching transistor for receiving the first switching signal, and a second switching transistor for receiving the second switching signal, the first voltage adjuster being configured to adjust a compensation voltage at an output node based on the first and second switching signals;

a controller to generate a first control signal in a high state beginning at a falling time point of a prediction signal and ending in response to a reset signal received by the controller, and to generate a second control signal in the high state beginning at a rising time point of the prediction signal and ending in response to the reset signal;

a compensator to receive the compensation voltage and output the compensation signal based on a voltage level of the compensation voltage, the compensation signal having a width in a high section that varies; and a booster to boost a response speed of-the compensation voltage of the output node based on the first and second switching signals when one of the first and second control signals is in the high state.

2. The power supply device as claimed in claim 1, wherein the booster includes:

a second voltage adjuster, connected in parallel to the first voltage adjuster, and configured to receive the first and second switching signals to adjust the voltage level of the compensation voltage based on the comparison result; and a switching circuit to control operation of the second voltage adjuster based on the first and second control signals.

3. The power supply device as claimed in claim 2, wherein, when the feedback voltage is less than the reference voltage, the comparator is configured to output a first switching signal in a high state through a first terminal and a second switching signal in a low state through a second terminal, and wherein, when the feedback voltage is greater than the reference voltage, the comparator is configured to output the first switching signal in a low state through the first terminal and the second switching signal in a high state through the second terminal.

4. The power supply device as claimed in claim 3, wherein the first voltage adjuster includes:

the first switching transistor including a gate electrode to receive the first switching signal, a drain electrode connected to a sourcing voltage terminal, and a source electrode connected to an output node to output the compensation voltage; and the second switching transistor including a gate electrode to receive the second switching signal, a drain electrode connected to the output node, and a source electrode connected to a reference voltage terminal.

5. The power supply device as claimed in claim 4, wherein the switching circuit includes:

a third switching transistor including a gate electrode to receive the first control signal, a drain electrode connected to the sourcing voltage terminal, and a source electrode connected to the second voltage adjuster; and a fourth switching transistor including a gate electrode to receive the second control signal, a drain electrode connected to the second voltage adjuster, and a source electrode connected to the reference voltage terminal.

6. The power supply device as claimed in claim 5, wherein the second voltage adjuster includes:

a fifth switching transistor including a gate electrode to receive the first switching signal, a drain electrode connected to the source electrode of the third switching transistor, and a source electrode connected to the output node; and a sixth switching transistor including a gate electrode to receive the second switching signal, a drain electrode connected to the output node, and a source electrode connected to the drain electrode of the fourth switching transistor.

7. The power supply device as claimed in claim 5, wherein the compensation circuit further includes a reset circuit to output the reset signal to reset the booster.

8. The power supply device as claimed in claim 7, wherein, when the reference voltage and the feedback voltage have a same magnitude, the comparator is configured to supply a third switching signal to the reset circuit.

9. A display device, comprising:

a display panel to display an image;

a driver to drive the display panel; and a power supply to supply a driving voltage to the driver, wherein the power supply includes:

a power circuit to generate an output voltage based on a PWM signal;

a feedback circuit, connected to an output terminal of the power circuit, to output a feedback voltage;

a compensation circuit to receive the feedback voltage, compare a reference voltage with the feedback voltage, and output a compensation signal according to a comparison result; and a PWM controller to adjust a duty ratio of the PWM signal based on the compensation signal, wherein the compensation circuit includes:

a comparator to compare the feedback voltage with the reference voltage and to concurrently output first and second switching signals;

a first voltage adjuster comprising a first switching transistor for receiving the first switching signal, and a second switching transistor for receiving the second switching signal, the first voltage adjuster being configured to adjust a compensation voltage at an output node based on the first and second switching signals;

a controller to generate a first control signal in a high state beginning at a falling time point of a prediction signal and ending in response to a reset signal received by the controller, and to generate a second control signal in the high state beginning at a rising time point of the prediction signal and ending in response to the reset signal;

a compensator to receive the compensation voltage and output the compensation signal based on a voltage level of the compensation voltage, the compensation signal having a width in a high section that varies; and a booster to boost a response speed of-the compensation voltage of the output node based on-the first and second switching signals when one of the first and second control signals is in the high state.

10. The display device as claimed in claim 9, wherein the compensation circuit further includes a reset circuit to output the reset signal to reset the booster.

11. The display device as claimed in claim 10, wherein the controller includes:

a detector to receive a load current from the power circuit and to calculate a representative load current based on the load current;

a comparator to compare the representative load current with a reference current and output a result signal based on a comparison result; and an A/D converter to convert the result signal to analog form.

12. The display device as claimed in claim 11, wherein the display device includes a signal controller configured to control a drive of the driver, configured to receive the result signal from the compensator, configured to generate the prediction signal based on the result signal, and configured to supply the prediction signal to the compensator.

13. The display device as claimed in claim 12, wherein the detector is configured to receive the load current by one frame unit during a detection section, and wherein the detection section corresponds to k frames, where k is a natural number of 1 or more.

14. The display device as claimed in claim 13, wherein i points are to be set at each of the k frames, and wherein the detector is configured to receive i load currents for the i points based on a reference clock and calculate the representative load current for each point based on a load current for each of the i points detected during the detection section.

15. The display device as claimed in claim 14, wherein the driver includes:

a data driver to supply a data signal to the display panel; and a gate driver to supply a gate signal to the display panel, wherein the signal controller is configured to generate the reference clock based on a vertical start signal to start operation of the gate driver and supply the reference clock to the detector.

16. The display device as claimed in claim 9, wherein the booster includes:

a second voltage adjuster, connected in parallel to the first voltage adjuster, and configured to receive the first and second switching signals to adjust the voltage level of the compensation voltage according to the comparison result; and a switching circuit to control operation of the second voltage adjuster based on the first and second control signals.

17. The display device as claimed in claim 16, wherein, when the feedback voltage is less than the reference voltage, the comparator is configured to output a first switching signal in a high state through a first terminal and a second switching signal in a low state through a second terminal, and wherein, when the feedback voltage is greater than the reference voltage, the comparator is configured to output the first switching signal in a low state through the first terminal and the second switching signal in a high state through the second terminal.

18. The display device as claimed in claim 17, wherein the first voltage adjuster includes:

a first switching transistor includes a gate electrode to receive the first switching signal, a drain electrode connected to a sourcing voltage terminal, and a source electrode connected to an output node to output the compensation voltage; and a second switching transistor including a gate electrode to receive the second switching signal, a drain electrode connected to the output node, and a source electrode connected to a reference voltage terminal.

19. The display device as claimed in claim 18, wherein the switching circuit includes:

a third switching transistor including a gate electrode to receive the first control signal, a drain electrode connected to the sourcing voltage terminal, and a source electrode connected to the second voltage adjuster; and a fourth switching transistor including a gate electrode to receive the second control signal, a drain electrode connected to the second voltage adjuster, and a source electrode connected to the reference voltage terminal.

20. The display device as claimed in claim 19, wherein the second voltage adjuster includes:

a fifth switching transistor including a gate electrode to receive the first switching signal, a drain electrode connected to the source electrode of the third switching transistor, and a source electrode connected to the output node; and a sixth switching transistor including a gate electrode to receive the second switching signal, a drain electrode connected to the output node, and a source electrode connected to the drain electrode of the fourth switching transistor.

* * * * *